United States Patent [19]

Fujiwhara et al.

[11] 4,233,400

[45] Nov. 11, 1980

[54] LIGHT-SENSITIVE SILVER HALIDE PHOTOGRAPHIC MATERIAL CONTAINING TETRAZOLIUM COMPOUNDS

[75] Inventors: Mitsuto Fujiwhara; Syunji Matsuo; Toyoaki Masukawa; Yutaka Kaneko; Mikio Kawasaki, all of Hino, Japan

[73] Assignee: Konishiroku Photo Industry Co., Ltd., Nihonbashi-muromachi, Japan

[21] Appl. No.: 16,988

[22] Filed: Mar. 2, 1979

Related U.S. Application Data

[63] Continuation of Ser. No. 818,507, Jul. 25, 1977, abandoned, which is a continuation-in-part of Ser. No. 710,385, Aug. 2, 1976, abandoned.

[30] Foreign Application Priority Data

Aug. 2, 1975 [JP] Japan ..... 50-94295

[51] Int. Cl.[3] ..... G03C 1/02

[52] U.S. Cl. ..... 430/523; 430/264; 430/265; 430/564; 430/567; 430/614; 430/949; 430/961

[58] Field of Search ..... 96/66, 663, 95, 107, 96/109, 137, 140, 141; 430/264, 564, 614

[56] References Cited

U.S. PATENT DOCUMENTS

| | | | |
|---|---|---|---|
| 3,071,465 | 1/1963 | Dersch et al. | 96/109 |
| 3,592,656 | 7/1971 | Brooks | 96/126 |
| 3,597,213 | 7/1971 | Dersch et al. | 96/109 |
| 3,708,303 | 1/1973 | Salesin | 96/107 |
| 3,765,901 | 10/1973 | Schellekens et al. | 96/140 |
| 3,832,180 | 8/1974 | Douglas | 96/66.3 |
| 3,909,268 | 9/1975 | Baldassarri et al. | 96/109 |

*Primary Examiner*—Travis Brown

*Attorney, Agent, or Firm*—Frishauf, Holtz, Goodman & Woodward

[57] ABSTRACT

Light-sensitive silver halide photographic materials to be treated with a hydroquinones-containing developing solution which material comprises a support and at least one hydrophilic colloidal layer coated thereon containing silver halide grains having an average grain size of 0.05 to 1.5$\mu$ and a tetrazolium compound and a method of processing thereof.

10 Claims, No Drawings

LIGHT-SENSITIVE SILVER HALIDE PHOTOGRAPHIC MATERIAL CONTAINING TETRAZOLIUM COMPOUNDS

This application is a continuation application of our application Ser. No. 818,507, filed July 25, 1977, now abandoned, which, in turn, is a continuation-in-part of our application Ser. No. 710,385, filed Aug. 2, 1976, and now abandoned in favor of Ser. No. 948,539, filed Oct. 4, 1978, as a continuation of said Ser. No. 710,385.

The present invention relates to a novel light-sensitive silver halide photographic material and the processing method therefor. Particularly, it relates to a novel lith type light sensitive silver halide photographic material for obtaining a photographic image with an especially high contrast, high sharpness and high resolving power, and to the processing method therefor.

More particularly, it relates to a novel light-sensitive silver halide photographic material which is applicable advantageously to a light-sensitive silver halide photographic material with a high contrast suitable for forming a dot- or line-image on a lith (printing) light-sensitive silver halide material or a copying light-sensitive material, as well as to the processing method therefor.

It has been known to form a photographic image with an extremely high contrast by using some kind of a light-sensitive silver halide photographic material.

It has been known, for example, to obtain a high contrast image, e.g. a line- or dot-image, by treating, with an alkaline hydroquinones developing solution containing sulfite ions in a very low concentration, a light-sensitive material which comprises a silver halide emulsion containing silver chloride in a high content (at least more than 50 mole %) and further containing silver iodide less than 5 mole %, the grains of which emulsion being minute (average grain size; ca. 0.3 $\mu$), uniform in size and shape, and the grain size distribution thereof being narrow. The above-mentioned kind of light-sensitive silver halide material is known as the lith type light-sensitive material.

In printing business, there is usually required such a process as to convert a continuous gradation original image to a dot image, i.e. a process to convert the densities of the continuous gradation to a predetermined numbered assembly of dots respectively having area of the same densities but proportional in size to the densities of the continuous gradation. In order to carry out this, the lith type light-sensitive material is subjected to development, after photographing the original image through a cross- or contract-screen, to form the dot image on the light-sensitive material.

For this purpose there has been employed a light-sensitive silver halide photographic material containing a silver halide emulsion, the grains of which being minute and being uniform in size and shape. Even when this kind of a light-sensitive silver halide photographic material is employed, the intermediate density region (undesired continuous gradation parts) is reproduced, beside the maximum density region and the minimum one (fog), when the material is processed with a standard black and white developing solution. The intermediate density region or the so-called flinge is undesirable for producing printing plates and makes the dot quality worse.

There has heretofore been employed the lith type light-sensitive material also for the reproduction of a line image. For the same reason, however, there have been obtained images having at best the $\gamma$-value of 5–6 of the characteristic curve, which value is lower than 7–9 required for forming the desirable line image, if the standard black and white developing solution is employed. In order to avoid this, there has been employed, as mentioned above, a specific developing solution called "an infectious developing solution". It is indispensable, however, to maintain the sulfite concentration in the infectious developing solution as low as possible to obtain a high contrast image, but such the developing solution is very poor in storability because of the low concentration of the sulfite so that this have caused a big trouble in printing business. Every effort has been made, however, to improve the storability. Nevertheless, such efforts have not been so successful. As a result, an ordinary developing solution for continuous gradation, such as Metol/hydroquinone or phenidone/-hydroquinone developing solution which is excellent in the storability, is recommended for processing the lith light-sensitive materials. However, there has been known no method capable of obtaining a dot image with a good dot quality, by using such the developing solution.

It is, therefore, the primary object of the invention to provide a novel light-sensitive silver halide photographic material and the processing method thereof to obtain a high contrast silver image.

It is another object of the invention to provide a lith type light-sensitive silver halide material containing a tetrazolium compound suitable for obtaining a dot- or line-image.

It is still another object of the invention to provide a novel processing method of the above-mentioned lith type light-sensitive silver halide material to obtain a high contrast black and silver image, especially a dot- or line-image.

The inventors have found, after extensive studies to attain the above-mentioned objects, that the objects can be attained by processing a lith type light-sensitive silver halide photographic material containing, in a hydrophilic colloidal layer, silver halide grains having a narrow grain size distribution and a tetrazolium compound, after exposure, with an ordinary developing solution containing a hydroquinones developing agent as a main developing agent.

In accordance with the invention, there can be formed a superior line- or dot-image, without employing the infectious development, by processing a light-sensitive silver halide photographic material having, coated on a support, at least one hydrophilic colloidal layer which comprises light-sensitive silver halide grains having an average grain size of 0.05–1.5 $\mu$ and at least 75% of the total grains being within the range of 0.6–1.4 times larger than the (average grain size) and a tetrazolium compound, after the image exposure, with a hydroquinones-containing developing solution.

According to a preferred embodiment of the invention, there is obtained a high contrast silver image with a superior reproducibility of the line image by processing a light-sensitive silver halide photographic material containing silver halide grains having the above-mentioned grain size and the distribution thereof (hereinafter referred to as the silver halide of the invention) and a diffusible tetrazolium compound after the image exposure, with a hydroquinones-containing developing solution.

According to another preferred embodiment of the invention, there is obtained a dot image (half tone image) with a superior dot quality by developing a light-sensitive silver halide photographic material containing the silver halide of the invention and a non-diffusible tetrazolium compound, after the image exposure through a contact screen, with ithe Metol/hydroquinone developing solution (hereinafter referred to as the MQ developing solution) or with the phenidone hydroquinone developing solution (hereinafter referred to as the PQ developing solution) which are famous and popular for the black and white developing solution.

It can not be expected from heretofore known techniques that the high contrast line- or dot-image could be obtained without employing the infectious developing solution.

As explained above, the tetrazolium compounds include non-diffusible and diffusible ones. The term "non-diffusible tetrazolium compound" means a compound which does not dissolve from the light-sensitive material to the developing solution during the development. In other words, the compound does not dissolve in a concentration of several %, preferably not more than 2%, when a gelatin layer containing the compound is dipped for 10 minutes in an aqueous solution at 20–40° C. having the same ion strength and pH-value as those of the developing solution.

The representative tetrazolium compounds employed in the invention include the following compounds represented by the general formulae:

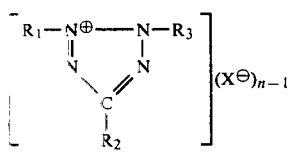

(I)

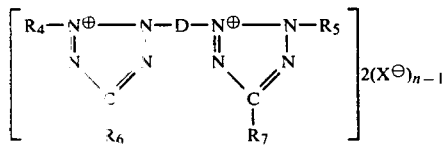

(II)

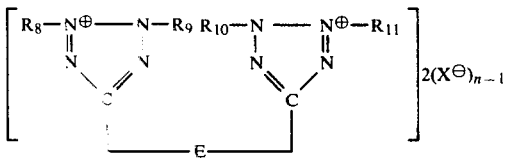

(III)

In the above formulae, $R_1$, $R_3$, $R_4$, $R_5$, $R_8$, $R_9$, $R_{10}$ and $R_{11}$ each represent a group selected from an aryl group such as a phenyl group (e.g. phenyl, tolyl, hydroxyphenyl, carboxyphenyl, aminophenyl or mercaptophenyl, carboxyethyl, nitrophenyl, ethoxyphenyl, iodophenyl, methoxyphenyl, cyanophenyl, acetamidophenyl, etc.) and a naphthyl group (e.g. α-naphthyl, β-naphthyl, hydroxynaphthyl, carboxynaphthyl or aminonaphthyl, etc.); and a heterocyclic group (e.g. thiadiazolyl, benzothiadiazolyl, oxazolyl, pyrimidinyl, pyridyl, 2,5-dimethyl-thiazolyl, etc.). The group can advantageously contain an electron sharing group capable of forming a metal chelate or a complex such as primary, secondary, tertiary amido oxide, thio ether, keto, thioketo, hydroxyl, mercapto, carboxyl, sulfo, phospho, alkoxyl and: $R_2$, $R_6$ and $R_7$ each represent a group selected from an aryl group such as a phenyl group and a naphthyl group, a heterocyclic group, an alkyl group (e.g. methyl, ethyl, propyl, butyl, mercaptomethyl or mercaptoethyl and a carboxyalkyl group such as a methoxycarbonyl or ethoxycarbonyl), hydroxyl, carboxy or the salt thereof, an amino group (e.g. amino. ethylamino or anilino), mercapto, nitro and hydrogen: D represents a divalent aromatic group; E represents a group selected from an alkylene group, an arylene group and an aralkylene group: X is an anion; and n is 1 or 2, provided that the compound forms an intramolecular salt when n is 1.

In the above formula; the divalent aromatic group for E is preferably an arylene group (e.g. phenylene, alkoxy-substituted phenylene such as methoxy-substituted phenylene, naphtylene, diphenylene, etc.) or a divalent aromatic heterocyclic group.

The following are typical examples of the cationic moieties of the tetrazolium compounds represented by the formula but not intended to limit the tetrazolium compound thereof.

(1) 2-(Benzothiazol-2-yl)-3-phenyl-5-dodecyl-2H-tetrazolium
(2) 2,3-Diphenyl-5-(4-t-octyloxyphenyl)-2H-tetrazolium
(3) 2,3,5-Triphenyl-2H-tetrazolium
(4) 2,3,5-Tri(p-carboxyethylphenyl)-2H-tetrazolium
(5) 2-(Benzothiazol-2-yl)-3-phenyl-5-(o-chlorophenyl)-2H-tetrazolium
(6) 2,3-Diphenyl-2H-tetrazolium
(7) 2,3-Diphenyl-5-methyl-2H-tetrazolium
(8) 3-(p-Hydroxyphenyl)-5-methyl-2-phenyl-2H-tetrazolium
(9) 2,3-Diphenyl-5-ethyl-2H-tetrazolium
(10) 2,3-Diphenyl-5-n-hexyl-2H-tetrazolium
(11) 5-Cyano-2,3-diphenyl-2H-tetrazolium
(12) 2-(Benzothiazol-2-yl)-5-phenyl-3-(4-tolyl)-2H-tetrazolium
(13) 2-(Benzothiazol-2-yl)-5-(4-chlorophenyl)-3-(4-nitrophenyl)-2H-tetrazolium
(14) 5-Ethoxycarbonyl-2,3-di(3-nitrophenyl)-2H-tetrazolium
(15) 5-Acetyl-2,3-di(p-ethoxyphenyl)-2H-tetrazolium
(16) 2,5-Diphenyl-3-(p-tolyl)-2H-tetrazolium
(17) 2,5-Diphenyl-3-(p-iodophenyl)-2H-tetrazolium
(18) 2,3-Diphenyl-5-(p-diphenyl)-2H-tetrazolium
(19) 5-(p-Bromophenyl)-2-phenyl-3-(2,4,6-trichlorophenyl)-2H-tetrazolium
(20) 3-(p-Hydroxyphenyl)-5-(p-nitrophenyl)-2-phenyl-2H-tetrazolium
(21) 5-(3,4-Dimethoxyphenyl)-3-(2-ethoxyphenyl)-2-(4-methoxyphenyl)-2H-tetrazolium
(22) 5-(4Cyanophenyl)-2,3-diphenyl-2H-tetrazolium
(23) 3-(p-Acetamidophenyl)-2,5-diphenyl-2H-tetrazolium
(24) 5-Acetyl-2,3-diphenyl-2H-tetrazolium
(25) 5-(Fur-2-yl)-2,3-diphenyl-2H-tetrazolium
(26) 5-(Thien-2-yl)-2,3-diphenyl-2H-tetrazolium
(27) 2,3-Diphenyl-5-(pyrid-4-yl)-2H-tetrazolium
(28) 2,3-Diphenyl-5-(quinol-2-yl)-2H-tetrazolium
(29) 2,3-Diphenyl-5-(benzoxazol-2-yl)-2H-tetrazolium
(30) 2,4-Diphenyl-5-nitro-2H-tetrazolium
(31) 2,2',3,3'-Tetraphenyl-5,5'-1,4-butylene-di-(2H-tetrazolium)
(32) 2,2',3,3'-Tetraphenyl-5,5'-p-phenylene-di-(2H-tetrazolium)
(33) 2-(4,5-Dimethylthiazol-2-yl)-3,5-diphenyl-2H-tetrazolium
(34) 3,5-Diphenyl-2-(triazin-2-yl)-2H-tetrazolium

(35) 2-(Benzothiazol-2-yl)-3-(4-methoxyphenyl)-5-phenyl-2H-tetrazolium
(36) 2,5-diphenyl-3-α-naphthyl-2H-tetrazolium
(37) 3,3'-(3,3'-dimethoxy-4,4'-diphenylene)-2,2',5,5'-tetraphenyl-di-(2H-tetrazolium)

As the anionic moieties, are mentioned, e.g. a halogen ion, a thiosulfate anion, a sulfate anion, a thiocyanate anion, an alkylsulfate anion, a intrate anion, an acetate anion, a lower alkylbenzene sulfonate anion for the diffusible tetrazolium compound and a higher alkylbenzenesulfonate anion such as p-dodecylbenzenesulfonate anion, a higher alkylsulfate anion such as laurylsulfate anion, a dialkylsulfosuccinate anion such as di-2-ethylhexylsulfosuccinate anion, a polyether alcohol sulfate anion such as cetylpolyethenoxysulfate anion, a higher fatty acid anion such as stearic acid anion, and a polymer having acid radicals such as polyacrylate anion for the non-diffusible tetrazolium compound.

Most typical examples of the compounds of the invention are as follows:

[1] Diffusible tetrazolium compound (1) 2,3,5-Triphenyl-2H-tetrazolium chloride
(2) 2,3,5-Tri(p-carboxyethylphenyl)-2H-tetrazolium iodide
(3) 2-(Benzothiazol-2-yl)-3-phenyl-5-(o-chlorophenyl)-2H-tetrazolium bromide
(4) 2,3-Diphenyl-2H-tetrazolium thiasulfate
(5) 2,3-Diphenyl-5-methyl-2H-tetrazolium chloride
(6) 3-(p-Hydroxyphenyl)-5-methyl-2-phenyl-2H-tetrazolium sulfate
(7) 2,3-Diphenyl-5-ethyl-2H-tetrazolium chloride
(8) 2,3-Diphenyl-5-n-hexyl-2H-tetrazolium chloride
(9) 5-Cyano-2,3-diphenyl-2H-tetrazolium thiocyanate
(10) 2-(Benzothiazol-2-yl)-5-phenyl-3-(4-tolyl)-2H-tetrazolium chloride
(11) 2-(Benzothiazol-2-yl)-5-(4-chlorophenyl)-3-(4-nitrophenyl)-2H-tetrazolium chloride
(12) 5-Ethoxycarbonyl-2,3-di(3-nitrophenyl)-2H-tetrazolium bromide
(13) 5-Acetyl-2,3-di(p-ethoxyphenyl)-2H-tetrazolium chloride
(14) 2,5-Diphenyl-3-(p-tolyl)-2H-tetrazolium methylsulfate
(15) 2,5-Diphenyl-3-(p-iodophenyl)-2H-tetrazolium chloride
(16) 2,3-Diphenyl-5-(p-diphenyl)-2H-tetrazolium chloride
(17) 5-(p-Bromophenyl)-2-phenyl-3-(2,4,6-trichlorophenyl)-2H-tetrazolium chloride
(18) 3-(p-Hydroxyphenyl)-5-methyl-2-phenyl-2H-tetrazolium chloride
(19) 5-(3,4-Dimethoxyphenyl)-3-(2-ethoxyphenyl)-2-(4-methoxyphenyl)-2H-tetrazolium chloride
(20) 5-(4-Cyanophenyl)-2,3-diphenyl-2H-tetrazolium chloride
(21) 3-(p-Acetamidophenyl)-2,5-diphenyl-2H-tetrazolium chloride
(22) 5-Acetyl-2,3-diphenyl-2H-tetrazolium chloride
(23) 5-(Fur-2-yl)-2,3-diphenyl-2H-tetrazolium chloride
(24) 5-(Thien-2-yl)-2,3-diphenyl-2H-tetrazolium chloride
(25) 2,3-Diphenyl-5-(pyrid-4-yl)-2H-tetrazolium nitrate
(26) 2,3-Diphenyl-5-(quinol-2-yl)-2H-tetrazolium chloride
(27) 2,3-Diphenyl-5-(benzoxazol-2-yl)-2H-tetrazolium chloride
(28) 2,3-Diphenyl-5-nitro-2H-tetrazolium methyls sulfate
(29) 2,2,',3,3'-Tetraphenyl-5,5'-1,4-butylene-di-(2H-tetrazolium chloride)
(30) 2,2',3,3'-Tetraphenyl-5,5'-p-phenylene-di-(2H-tetrazolium chloride)
(31) 2-(4,5-Dimethylthiazol-2-yl)-3,5-diphenyl-2H-tetrazolium
(32) 3,5-Diphenyl-2-(triazin-2-yl)-2H-tetrazolium sulfate
(33) 2-(Benzothiazol-2-yl)-3-(4-methoxyphenyl)-5-phenyl-2H-tetrazolium chloride
(34) 2,5-diphenyl-3-α-naphthyl-2H-tetrazolium chloride
(35) 3,3'-(3,3'-dimethoxy-4,4'-diphenylene)-2,2',5,5'-tetraphenyl-di-(2H-tetrazolium chloride)
(36) 5-(3-methoxyphenyl)-3-(3-trifluoromethylphenyl)-2-phenyl-2H-tetrazolium acetate

[2] Non diffusible tetrazolium compound

(37) 2-(Benzothiazol-2-yl)-3-phenyl-5-dodecyl-2H-tetrazolium bromide
(38) 2,3-Diphenyl-5-(4-t-octyloxypheny)-2H-tetrazolium chloride
(39) 2,3,5-Triphenyl-2H-tetrazolium diethylhexylsuccinate sulfonate
(40) 2,3,5-Tri(p-carboxyethylphenyl)-2H-tetrazolium p-dodecylbenzene-sulfonate.
(41) 2-(Benzothiazol-2-yl)-3-phenyl-5-(o-chlorophenyl)-2H-tetrazolium diethylhexylsuccinate sulfonate
(42) 2,3-Diphenyl-2H-tetrazolium p-octylbenzenesulfonate
(43) 2,3-Diphenyl-5-methyl-2H-tetrazolium laurylsulfate
(44) 3-(p-Hydroxyphenyl)-5-methyl-2-phenyl-2H-tetrazolium isopropylnaphthalenesulfonate
(45) 2,3-Diphenyl-5-ethyl-2H-tetrazolium di-ethylhexylsulfosuccinate
(46) 2,3-Diphenyl-5-n-hexyl-2H-tetrazolium cetylpolyethenoxysulfate
(47) 5-Cyano-2,3-diphenyl-2H-tetrazolium polyacrylate
(48) 2-(Benzothiazol-2-yl)-5-phenyl-3-(4-tolyl)-2H-tetrazolium diethylhexylsuccinate sulfonate
(49) 2-(Benzothiazol-2-yl)-5-(4-chlorophenyl)-3-(4-nitrophenyl)-2H-tetrazolium diethylhexylsuccinate sulfonate
(50) 5-Ethoxycarbonyl-2,3-di(3-nitrophenyl)-2H-tetrazolium-diethylhexylsuccinate sulfonate
(51) 5-Acetyl-2,3-di(p-ethoxyphenyl)-2H-tetrazolium-diethylhexyesuccinate sulfonate
(52) 2,5-Diphenyl-3-(p-tolyl)-2H-tetrazolium-p-octylbenzenesulfonate
(53) 2,5-Diphenyl-3-(p-iodophenyl)-2H-tetrazolium-p-ocytlbenzenesulfonate
(54) 2,3-Diphenyl-5-(p-diphenyl)-2H-tetrazolium-p-octylbenzenesulfonate
(55) 5-(p-Bromophenyl)-2-phenyl-3-(2,4,6-trichlorophenyl)-2H-tetrazolium isopropylnaphthalenesulfonate
(56) 3-(p-Hydroxyphenyl)-5-(p-nitrophenyl)-2-phenyl-2H-tetrazolium diethylhexylsuccinate sulfonate
(57) 5-(3,4-Dimethoxyphenyl)-3-(2-ethoxyphenyl)-2-(4-methoxyphenyl)-2H-tetrazolium diethylhexylsuccinate sulfonate
(58) 5-(4-Cyanophenyl)-2,3-diphenyl-2H-tetrazolium diethylhexylsuccinate sulfonate

(59) 2-(p-Acetamidophenyl)-2,5-diphenyl-2H-tetrazolium laurylsulfate
(60) 5-Acetyl-2,3-diphenyl-2H-tetrazolium diethylhexylsuccinate sulfonate
(61) 5-(Fur-2-yl)-2,3-diphenyl-2H-tetrazolium diethylhexylsuccinate sulfonate
(62) 5-(Thien-2-yl)-2,3-diphenyl-2H-tetrazolium diethylhexylsuccinate sulfonate
(63) 2,3-Diphenyl-5-(pyrid-4-yl)-2H-tetrazolium diethylhexylsuccinate sulfonate
(64) 2,3-Diphenyl-5-(quinol-2-yl)-2H-tetrazolium diethylhexylsuccinate sulfonate
(65) 2,3-Diphenyl-5-(benzoxazol-2-yl)-2H-tetrazolium diethylhexylsuccinate sulfonate
(66) 2,4-Diphenyl-5-nitro-2H-tetrazolium polyacrylate
(67) 2,2',3,3'-Tetraphenyl-5,5'-1,4-butylene-di-(2H-tetrazolium) laurylsulfate
(68) 2,2',3,3'-Tetraphenyl-5,5'-p-phenylene-di-(2H-tetrazolium) cetylpolyethenoxysulfate
(69) 2-(4,5-Dimethylthiazol-2-yl)-3,5-diphenyl-2H-tetrazolium polyacrylate
(70) 3,5-Diphenyl-2-(triazin-2-yl)-2H-tetrazolium stearate
(71) 2-(Benzothiazol-2-yl)-3-(4-methoxyphenyl)-5-phenyl-2H-tetrazolium di-ethylhexylsulfosuccinate
(72) 2,5-Diphenyl-3-α-naphthyl-2H-tetrazolium dodecylsulfate
(73) 3,3'-(3,3'-Dimethoxy-4,4'-diphenylene)-2,2',5,5'-tetraphenyl-di-(2H-tetrazolium polyacrylate)
(74) 2-(3-Methyloxyphenyl)-3-(3-trifluoromethylphenyl)-2-phenyl-tetrazolium isopropylnaphthalenesulfonate The non-diffusible or diffusible tetrazolium compounds according to the invention are thus synthesized by an optional selection of the anionic and cationic moiety. The non-diffusible compounds, e.g. 2,3,5-triphenyl-2H-tetrazolium dioctyl-succinate-sulfonate, may be dispersed into a gelatin solution by mixing the respective soluble tetrazolium salt and the gelation to disperse them in the gelatin solution and then by that optimum anion is admixed thereinto thereby to obtain the gelatin solution dispersed with the non-diffusible tetrazolium compound as specifically mentioned in Examples set forth later.

Alternatively, crystals of the non-diffusible tetrazolium compound purely synthesized may be dissolved in a suitable solvent such as dimethylsulfoxide and then dispersed in the gelatin solution. When the dispersion is not sufficiently homogeneous, good results may be obtained by exposing the emulsion dispersion to an ultrasonic wave or by use of a suitable homogenizer such as Manton-Gaulin homogenizer.

As mentioned above, the tetrazolium compounds of this invention may be used both in diffusible and non-diffusible forms, when the silver halide of this invention is employed. However, the higher contrast image may be obtained by employing the non-diffusible tetrazolium compounds. Accordingly, it is advantageous to employ the non-diffusible tetrazolium compound when an especially superior dot quality is required.

On the other hand, the use of too much contrast light-sensitive material sometimes brings about not sufficient reproduction of the line image, particularly those of fine letters and lines. In this case an image with more superior quality may be obtained by the use of the diffusible tetrazolium compounds.

According to a preferred embodiment of the invention, the tetrazolium compound of the invention is incorporated into a silver halide emulsion layer.

According to another preferred embodiment of the invention, the compound is incorporated in a layer adjacent (or a layer adjacent to said adjacent layer) to the layer containing the silver halide emulsion.

The above-mentioned compounds of the invention may preferably be employed in an amount of 0.0001–10 mole, more preferably 0.001–1 mole, per mole of the silver halide contained in the light-sensitive silver halide photographic material of the invention. As the silver halide employed for the light-sensitive silver halide photographic material of the invention includes any silver halide used for the conventional silver halide photographic materials, e.g. silver bromide, silver chlorobromide, silver iodobromide, silver chloroiodobromide or silver chloride and the like.

The average grain size of the silver halide in the invention is 0.05–1.5 μ, preferably 0.1–0.8 μ, and at least 75% of the total grains are within a range of 0.6–1.4, preferably 0.7–1.3 times larger than the average grain size. Furthermore, the silver halide comprises silver chlorobromide or chloroiodobromide containing at least 50 mole % silver chloride. The silver halide of the invention having the above-mentioned average grain size and the distribution thereof may be prepared by any known method described, e.g. in U.S. Pat. Nos. 2,592,250, 3,276,877, 3,317,322, 2,222,264, 3,320,069 and 3,206,313 and in Journal of Photographic Science 12(5), 242–251 (1964).

Silver halides prepared by other methods may also be employed in mixture.

According to the most preferred concrete embodiment of the invention, the silver halide of the invention is silver chloroiodobromide or chlorobromide having an average grain size of 0.1–0.5 μ and at least 80% of the total grains being within a range of 0.7–1.3 times larger than the average grain size.

The silver halide emulsion of the invention may be sensitized with various kinds of chemical sensitizers. As the sensitizer, are mentioned, for example, activated gelatin, sulfur sensitizers (e.g. sodium thiosulfate aryl thiocarbamide, thiourea or aryl isocyanate, etc.), selenium sensitizers (e.g. N,N-dimethylserenourea or selenourea, etc.), reducing sensitizers (e.g. triethylenetetramine or stannic chloride, etc.) and various noble metal sensitizers represented by potassium chloroaurite, potassium auriothiocyanate, potassium chloroaurate, 2-auro-sulfobenzothiazole methylchloride, ammonium chloropalladate, potassium chloroplatinate and sodium chloropalladite. The sensitizer may be employed alone, or mixed together. Ammonium thiocyanate may be auxiliarily employed when a gold sensitizer is employed.

Furthermore, the silver halide emulsion used in the invention may be sensitized optically with one or more sensitizing dyes to give a light sensitivity within the desired light-sensitive wave length.

Various kinds of sensitizing dyes may be employed for the purpose. As the optical sensitizers employed advantageously in the invention are mentioned, e.g. a cyanine, merocyanine, tri- or tetranuclei merocyanine, tri- or tetranuclei cyanine, styryl, holopolar cyanine, hemicyanine, oxonole, hemioxonole, and the like.

The optical sensitizers preferably contain within the chemical structure thereof a nitrogen-containing heterocyclic nucleus, e.g. a basic group such as thiazoline or thiazole, or rhodanine, thiohydantoin, oxazolidinedione, barbituric acid, thiobarbituric acid or pyrazolone. The nucleus may be substituted with an alkyl, hydroxyalkyl, halogen, phenyl, cyano or alkoxy group or may be fused with a hydrocarbon or heterocyclic ring.

The silver halide emulsion of the invention may preferably be stabilized with 5,6-trimethylene-7-hydroxy-s-triazole(1,5-a)pyrimidine, 5,6-tetramethylene-7-hydroxy-s-triazolo(1,5-a)pyramidine, 5-methyl-7-hydroxy-s-triazolo-(1,5-a)pyrimidine, 7-hydroxy-s-triazolo(1,5-a)pyrimidine, 5-methyl-6-bromo-7-hydroxy-s-triazolo(1,5-a) pyrimidine, esters or salts of gallic acid (e.g. isoamyl gallate, dodecyl gallate, propyl gallate or sodium gallate), mercaptans (e.g. 1-phenyl-5-mercaptotetrazole or 2-mercaptobenzothiazole), benzotriazoles (e.g. 5-bromobenzotriazole or 4-methylbenzotriazole) and benzimidazoles (e.g. 6-nitrobenzimidazole). Such stabilizers are described in, e.g. U.S. Pat. Nos. 2,444,607, 2,716,062, 3,512,982, 3,342,596, 3,726,686 and 3,717,465, British Pat. No. 1,363,921. Furthermore, the silver halide emulsion of the invention may contain a latent image stabilizer such as a sulfur-containing amino acid, or a gradation-adjusting agent such as a cadmium or rhodium salt, described in, e.g. British Pat. No. 1,343,904 and U.S. Pat. No. 3,821,295.

It has been known in, e.g. British Pat. No. 775,197 and U.S. Pat. No. 3,488,709, to employ a rhodium or cadmium salt to increase the contrast of silver halide emulsion. However, problems still remain when the rhodium salt is employed. For example, the use of rhodium salt tends to cause an unevenness of the product due to the minute amount of addition and the narrow allowable range thereof of the salt, and thus makes it difficult to produce stable photographic materials. In case of the cadmium salt, it has to be added as little as possible from an ecological viewpoint, for it is washed out by film-processing and comes finally into the environment. The cadmium salts are known to prevent the metabolism and to be harmful to living tissues. Cadmium may be detected not only in air but also in the body of sea animals. As a result of interest in public health and in the maintenance of normal ecological balance in view of the toxicity of rare metals, including cadmium mentioned above, the inventors have reached the invention relating to a novel method to obtain a light-sensitive material with sufficiently high contrast, even in no use of such harmful metals. When the above-mentioned silver halide and tetrazolium compound of the invention are incorporated into the hydrophilic colloidal layer.

The hydrophilic colloid advantageously employed in the invention is gelatin. As other hydrophilic colloids than gelatin are mentioned, e.g. colloidal albumin, agar, gum arabic arginic acid, hydrolyzed cellulose acetate, acrylamide, imidated polyamide, polyvinyl alcohol, hydrolized polyvinyl acetate, water-soluble polymer described in, e.g. British Pat. No. 523,661, U.S. Pat. Nos. 3,847,620, 3,655,389 and 3,341,332, gelatin derivatives such as phenylcarbamyl-acylated- or phthalated-gelatin described in, e.g. U.S. Pat. Nos. 2,614,928 and 2,525,753, or graft-polymerized monomers on gelatin having the ethylene group and being capable of polymerization, such as acrylic acid and the ester thereof, styrene, a methacrylic acid and the ester thereof, described in e.g. U.S. Pat. Nos. 2,548,520 and 2,831,767. Such hydrophilic colloids may also be applied to a layer containing no silver halide, e.g. an antihalation layer, a protective layer or an intermediate layer.

The light-sensitive silver halide material of the invention may be prepared by coating the above-mentioned layer containing the silver halide and the tetrazolium compound of the invention on a suitable photographic base. As the representative supports employed in the invention are mentioned, e.g. a baryta paper, a polyethylene-coated paper, a synthetic polypropylene paper, a glass plate, a cellulose acetate or cellulose nitrate film, a polyester film such as a polyethylene terephthalate film, a polyamide film, a polypropylene film, a polycarbonate film, a polystyrene film and the like. The supports are optionally selected depending on the purpose for which the light-sensitive photographic material is used.

As mentioned above, the light-sensitive silver halide photographic material of the invention comprises at least one hydrophilic colloidal layer, coated on the support, containing a silver halide of this invention and the tetrazolium compound of the invention.

It is preferable in the light-sensitive material of the invention that a protective layer having a suitable thickness is coated. The protective layer is advantageously a gelatin layer, the thickness of which is preferably 0.1–10 $\mu$, more preferably 0.8–2.0 $\mu$.

The hitherto known lith type light-sensitive silver halide photographic materials usually have a protective layer. In this invention, however, the protective layer plays an important roll different from known ones.

The protective layer is, in general, coated for the purpose to protect the silver halide emulsion layer from an incidental mechanical damage during production processes, e.g. cutting, winding or wrapping process, or during photographing and/or processing caused by contact of the light-sensitive material with other substance.

It has turned out that the protective layer of the invention not only protects the above-mentioned silver halide emulsion but also plays an important roll for processing stability. That is, while the lith type light-sensitive material has to be able to form a very high contrast line- and dot-image, if a compound oxidizable of a hydroquinone developing agent is added in the light-sensitive silver halide photographic material to obtain the above-mentioned high contrast silver image, the above-mentioned oxidizing agent gives a large influence on the development during the progress thereof and consequently, the quality of the line- or dot-image obtained is largely influenced by the difference of e.g. a developing time, a temperature and an amount of the exposure.

It is not necessarily elucidated in the process of the invention why the presence of the protective layer may act effectively on the stability of the image quality and of the developing process. Presumably, the protective layer may have a function to control adequately the infiltration rate of the hydroquinone/Metol or phenidone from the processing solution into the light-sensitive material, or the diffusion rate of the tetrazolium compound within the light-sensitive material or therefrom to the processing solution.

This effect is remarkable when the tetrazolium compound of the invention is employed. The effect is not so remarkable when other oxidizing agent than the tetrazolium compound, described in, e.g. Japenese Patent Application No. 50-94295 are employed.

Various kinds of photographic additives may optionally be added to the above-mentioned hydrophilic colloid of the invention, as far as they do not impair the effect of the invention. As the additives, are mentioned, e.g. a gelatin plasticizer, a hardening agent, a surface active agent, an image stabilizer, an ultraviolet absorber, an antistaining agent, a pH adjuster, an antioxidant, an antistatic agent, a viscosity-increasing agent, a granularity improving agent, a dye, a mordant, a brightening agnet, a development regulator, a matting agent, and the like.

Among the additives mentioned above, the following may particularly and preferably be employed: viscosity-increasing agents and plasticizers, described in U.S. Pat. Nos. 2,960,404, 3,767,410, 3,659,956 and 3,692,753, e.g. a styrene/sodium maleate copolymer and dextran sulfate, etc; hardening agents of an aldehyde, epoxy, ethyleneimine, active halogen, vinylsulfone, isocyanate, sulfinic acid ester, carbodiimide, a mucochloric acid, or acyloyls, etc.; image stabilizers, e.g. 6,6'-butylidene-bis(2-t-butyl-4-methylphenol) and 4,4'-methylene-bis(2,6-di-t-butylphenol), etc.; ultra violet absorbers, described in, e.g. U.S. Pat. No. 3,253,921, British Pat. No. 1,309,349, U.S. Pat. Nos. 3,533,794 and 3,707,375 and British Pat. No. 1,287,770, particularly 2-(2-hydroxy-5-t-butylphenyl)-benzotriazole, 2-(2-hydroxy-3,5-di-t-butylphenyl)benzotriazole, 2-(2-hydroxy-3-t-butyl-5-butylphenyl)-5-chlorobenzotriazole and 2-(hydroxy-3,5-di-t-butylphenyl)-5-chlorobenzotriazole; surface active agents for coating aids; emulsifiers, infiltration-improving agents for a processing solution, defoamers, or agents for controlling various physical properties of the light-sensitive material, described in, e.g. U.S. Pat. Nos. 3,026,202 and 3,514,293, British Pat. Nos. 548,532 and 1,216,389, U.S. Pat. No. 3,726,683, including anionic, cationic, nonionic and amphoteric compounds; mordants described in, e.g. U.S. Pat. Nos. 2,113,381 and 2,548,564; antistaining agents described in, e.g. U.S. Pat. Nos. 2,360,210, 2,728,659, 2,732,300 and 3,700,453, particularly 2-methyl-5-hexadecyl-hydroquinone, 2-methyl-5-sec-octadecylhydroquinone and 2,5-di-t-octylhydroquinone, etc.; antistatic agents described in, e.g. U.S. Pat. Nos. 2,882,157, 2,972,535, and 3,573,093 and British Patent No. 1,378,584 and U.S. Pat. Nos. 3,549,369, 3,704,128 and 3,663,230; matting agents described in, e.g. U.S. Pat. Nos. 2,992,101 and 2,956,884, British Pat. Nos. 1,221,980 and 1,307,373, particularly silica gel having a grain size of 0.5–20 $\mu$ and polymethylmethacrylate having a grain size of 0.5–20 $\mu$; developing promotors, e.g. benzyl alcohol and a polyoxyethylene series compound which may be added in the processing bath.

In accordance with the process of the invention, there is obtained a high contrast silver image. The invention is therefore applicable to various fields wherein a high contrast black and white recording is required. The light-sensitive material of the invention is, for example, applied preferably to a printing- or micro-sensitive material.

The process of the invention for forming a lith type photographic image has superior characteristics which no conventional processes have reached yet.

It is not necessarily elucidated why the high contrast silver image may be obtained according to the process of the invention. It is presumed that the semiquinone produced by oxidation of hydroquinone in the developing solution by the tetrazolium compound may be accumulated in an abnormally high concentration near the developed silver.

It is said, in general, that the so-called "infectious phenomenon" does not take place due to instantaneous removal of the semiquinone or quinones by sulfonation when the sulfite ions are in a high concentration in the developing solution. Whereas, in the present process, it is presumed as if the infectious development takes place at the position of the exposed silver halide in the gelatin layer due to predominant supply of the semiquinone.

It is accordingly essential in the process of the invention to treat with a developing solution containing a hydroquinone developing agent. The lith type developing solution (infectious developing solution), however, is not essentially required as far as the solution is of hydroquinones, by which high contrast lith type silver image may sufficiently be obtained even in the presence of sulfite ion in a high concentration.

The process of the invention differs apparently from the conventional processes in that no conventional lith type developing solution which contains hydroquinone, alkali, alkali metal bromide, sulfite ion in low concentration, and as a preserver a condenstaion product of formaldehyde/sodium bisulfite or carbonylbisulfite amine is needed, although the use of such components may of course be possible.

As the hydroquinone type developing agents employed in the invention are mentioned, e.g. hydroquinone, chlorohydroquinone, bromohydroquinone, isopropylhydroquinone, toluhydroquinone, methylhydroquinone, 2,3-dichlorohydroquinone, 2,5-dimethylhydroquinone, 2,3-dibromohydroquinone, 2,5-dihydroxyacetophenone, 2,5-diethylhydroquinone, 2,5-di-p-phenethylhydroquinone, 2,5-dibenzoylaminohydroquinone, and the like.

The developing solution containing the hydroquinones developing agent employed in the invention includes not only the so-called lith type developing agent but also the gradient MQ and PQ developing solution, the latters of which are advantageously employed in the invention because of the easiness of preparation and superior preservability. Among these developing solutions, those which show the superadditivity are preferred. For example, the developing agents and the additives therefor described in "The Theory of Photographic Process", Third Edition, pp 374–378 (1966) are advantageously employed. A preserver like sulfite salts such as sodium sulfite, potassium sulfite or ammonium sulfite may jointly be employed in the developing solution used in the invention without impairing the effect of the invention; and this is another characteristic of the invention. The adjustment of pH and giving a buffer function with an alkali hydroxide, alkali carbonate or amine, or addition of inorganic development retarder such as potassium bromide or of organic development retarder such as benzotriazole may optionally be carried out as in the standard black and white developing solution.

In the invention the phrase "treat with a developing solution containing hydroquinones developing agent'-'means to carry out development of the exposed material of the invention with the developing solution which satisfies the above-mentioned conditions, and various modes may be included therein. For example, the temperature at which development is carried out is preferably below 50° C., more preferably around 30° C., and the time required for development is generally within 30 minutes, more preferably within 5 minutes, by which good results are obtained, in general.

After the development, the subsequent processes such as washing, stopping, stabilizing and fixing are carried out. If necessary, processes like prehardening and neutralization and the like may be adopted, but they may optionally be omitted. The processes may be carried out either by the so-called manual treatment like a bath- or tray-development or by the mechanical treatment like a rollar- or hanger-development. According to a preferred embodiment of the invention, the processing solution in the bath development was more than 20 times stabler over long period than the conventional lith type developing solution. Especially, when the known particular developing solution containing sulfite ion in an extremely low concentration is employed in order to improve the dot quality of the lith type light-sensitive material, it became of no use for several hours. While, according to a preferred method of the invention, the processing solution could be stably employed after one month has passed, and the dot quality using the solution was then comparable to that using a newly prepared solution.

Furthermore, addition of a contrast agent often used for the conventional high contrast developing solution to the developing solution employed in the invention gives no undesirable influence on the photographic quality.

As can be clearly understood by the explanations given above, the invention relates to a novel light-sensitive silver halide photographic material and the processing method thereof which may obtain a superior line- or dot-image by processing the light-sensitive silver halide photographic material comprising a tetrazolium salt and a silver halide having a narrow grain size distribution, with a developing solution containing hydroquinone, using no infectious developing solution.

According to the process of the invention, there is obtained a high contrast silver image even when the diffusible tetrazolium compound is employed. There may also be obtained a dot image which is superior to that obtained by the method described in Japanese Patent Application No. 50-94295, when the non-diffusible tetrazolium compound is employed.

The invention is further concretely explained by the following Examples, which by no means restrict the scope of the invention:

COMPARISON 1

A silver chloroiodobromide-gelatin emulsion comprising silver halide of 80 mole % chloride, 19 mole % bromide and 1 mole % iodide, having an average grain size of 0.3 $\mu$ and of 80% grains within a range of 0.26–0.36 $\mu$ was sensitized chemically with sulfur- and gold-sensitizers. To the emulsion were added polyethyleneglycol (m.w.=1540) oleic acid ether in an amount of 200 mg per mole of silver, and further 4-hydroxy-6-methyl-1,3,3a,7-tetraazaindene and spiro-bis(3,3-dimethyl-5,6-dihydroxyindane) in amounts of 100 mg and 20 mg per mole of silver, respectively. The emulsion was coated on a polyethylene terephthalate support in such amounts that those of the silver and the gelatin were 55 mg and 50 mg per 100 $cm^2$, respectively. Further, on the silver halide emulsion layer, was coated gelatin in an amount of 30 mg per 100 $cm^2$ as a protective layer. The above-mentioned elements were wedge-exposed with a tungsten lamp through a gray contact screen and then processed at 30° C. according to the following processes:

Developing: 1.5 min.
Stop fixing: 2 min.
Washing: 5 min.
Drying.

The following compositions were employed in the processing bath:

[Developing solution]
Metol:3.5 g
Anhydrous sodium sulfite:60 g
Hydroquinone:9.0 g
Sodium carbonate:54 g
Potassium bromide: 2.5 g
5-Nitrobenzimidazole: 0.5 g
1-Phenyl-5-mercaptotetrazole: 20 mg
Water: to make 1 liter (pH=10.25)

[Stop fixer]
Ammonium thisulfate decahydrate: 150 mg
Anhydrous sodium sulfite: 10g
Sodium acetate trihydrate: 15 g
Glacial acetaic acid: 15 ml
Water: to make 1 liter (pH=4.20)

COMPARISON 2

Comparison 1 was repeated, except that potassium dichromate was added, in advance of coating, to the emulsion in an amount of 4 g per mole of silver.

COMPARISON 3

Comparison 1 was repeated, except that potassium persulfate was added, in advance of coating, to the emulsion in an amount of 4.0 g per mole of silver instead of potassium dichromate used in Comparison 1.

EXAMPLE 1

A material was prepared in the similar manner as in Comparison 1, except that 2,3,5-triphenyl-tetrazolium chloride (Compound (1)) was added, in advance of coating, to the emulsion in an amount of 4.5 g per mole of silver instead of potassium dichloromate used in Comparison 1.

EXAMPLE 2

A material was prepared in the similar manner as in Comparison 1, except that 3-(p-hydroxyphenyl)-5-methyl-2-phenyl-2H-tetrazolium chloride (Compound (18)) was added, in advance of coating, to the emulsion in an amount of 4.0 g per mole of silver instead of potassium dichromate used in Comparison 1.

EXAMPLE 3

A material was prepared in the similar manner as in Comparison 1, except that 2,3-diphenyl-5-ethyl-2H-tetrazolium chloride (Compound(7) was added, in advance of coating, to the emulsion in an amount of 4.0 g per mole of silver instead of potassium dichromate used in Comparison 1.

EXAMPLE 4

A material was prepared in the similal manner as in Comparison 1, except that a non-diffusible tetrazolium compound (Compound (66)) synthesized from 2,3-diphenyl-5-nitro-2H-tetrazolium chloride and polyacrylic acid was added, in advance of coating, to the emulsion in an amount of 8 g per mole of silver instead of potassium dichromate used in Comparison 1.

The results of Comparisons 1 to 3, and Examples 1 to 4 are summarized in Table 1.

TABLE 1

| Photographic performance Sample | Relative sensitivity | γ | Fog | Dot quality |
|---|---|---|---|---|
| Comparison 1 | 100 | 6.42 | 0.06 | 2.0 |
| Comparison 2 | 91 | 6.74 | 0.04 | 2.5 |
| Comparison 3 | 89 | 6.66 | 0.04 | 2.5 |
| Example 1 | 80 | 10.22 | 0.04 | 3.5 |
| Example 2 | 83 | 9.87 | 0.04 | 3.0 |
| Example 3 | 85 | 10.03 | 0.04 | 3.5 |
| Example 4 | 82 | 12.85 | 0.04 | 5.0 |

As clearly shown in Table 1, the material according to the invention increase contrast very effectively and have a dot quality superior to other known oxidizing agents even when processed with the MQ developing solution, and therefore, has superior properties for the lith type lightsensitive material for the line- and dot-image use. Here, the term "dot quality" means an evaluation value for the reproduction quality of the half tone image.

The "lith type" photographic element (exposed using a half tone image and developed) produces usually a part called "shadow dot" and a part called "highlight part".

The intermediate part which is between the two parts has various sizes. The term "dot quality" referred to herein means an evaluation value of a part called "50 % dot", i.e. the concentration at which 50 % is clear and 50 % is clear and 50 % is developed, and is expressed by a progressive scale. Namely "4" means to be excellent and "1" means to be extremely bad. It is not normally allowed that the 50 % dot quality is less than "3 ".

It has turned out, among the above-mentioned materials according to the invention, the use of the diffusible tetrazolium salt (Examples 1, 2 and 3) produces an slightly lower γ- value and dot quality, but of a rather superior characteristic for the reproduction of the line image, as compared with the use of the non-diffusible tetrazolium salt (The characteristic of line image was estimated visually by the reproducibility of the Chinese character "UTSU".).

COMPARISON 4

A silver chloroiodobromdie/gelating emulsion comprising silver halide of 50 mole % chloride, 49 mole % bromide and 1 mole % iodide, having an average grain size of 0.25 μand 75 % grain within a range of 0.23–0.28 μ was sensitized chemically with sulfur- and gold-sensitizers. To the emulsion were added polyethyleneglycol (m.w. = 1420) oleic acid ether in an amount of 200 mg per mole of silver, and further 4-hydroxy- 6-methyl-1,3,3a,7-tetraazaindene in an amount of 300 mg per mole of silver. The emulsion was coated on a polyethylene tetraphthalate support in such amounts that those of the silver and the gelatin were 55 mg and 50 mg per 100 $cm^2$, respectively.

Further, on the silver halide emulsion layer, was coated gelatin in an amount of 30 mg per 100 $cm^2$ as a protective layer. The above-mentioned material was wedge-exposed with a tungsten lamp through a gray contact screen and then processed at 30° C. according to the following processes:

Developing: 2 min.
Stop fixing: 2 min.
Washing: 5 min.
Drying.

The processing bath was composed as follows:

[Developing solution]
Formaldehyde/sodium acid sulfite adduct: 50 g
Hydroquinone: 15 g
Boric acid: 8 g
Anhydrous sodium sulfite: 2 g
Sodium carbonate monohydrate: 85 g
Potassium bromide: 2.5 g
6-Nitroindazole: 0.1 g
Water: to make 1 liter (pH = 10.00)

The same composition as in Comparison 1 was employed for the fixing solution.

COMPARISON 5

Comparison 4 was repeated, except that hexaamminecobalt hydrochloride was added, in advance of coating, to the emulsion in an amount of 3 g per mole of silver and that the following processing bath composition was employed:

[Developing solution]
Metol: 3.5 g
Anhydrous sodium sulfite: 40 g
Hydroquinone: 9.0 g
Sodium carbonate monohydrate: 54 g
Potassium bromide: 2.5 g
6-Nitroindazole: 0.1 g
Water: to make 1 liter (pH = 10.25).

COMPARISON 6

Comparison 5 was repeated, except that Chloramine T (tosylchloramide sodium) was added, in advance of coating, to the emulsion in an amount of 3 g per mole of silver instead of hexaamminecobalt chloride used in Comparison 5.

EXAMPLE 5

Comparison 5 was repeated, except that 2,5 -diphenyl-3-α-naphthyltetrazolium chloride (compound (34)) was added, in advance of coating, to the emulsion in an amount of 4 g per mole of silver instead of hexaamminecobalt used in Comparison 5.

EXAMPLE 6

Comparison 5 was repeated, except that 3,3'-(3,3'-dimethoxy-4,4'-diphenylene)-2,2'5,5'-phenyltetra-di-(2H-tetrazolium chloride) (Compound (35)) was added, in advance of coating, to the emulsion in an amount of 2 g per mole of silver instead of hexaamminecobalt used in Comparison 5.

EXAMPLE 7

Example 6 was repeated, except that sodium dibutylhexylsuccinate sulfonate was further added in an amount of 1 g per liter to the developing solution used in Comparison 5.

The result of Comparisons 4 to 6 and Examples 5 to 7 are summarized in Table 2.

TABLE 2

| photographic performance Sample | Relative Sensitivity | γ | Fog | Dot quality |
|---|---|---|---|---|
| Comparison 4 | 100 | 4.40 | 0.06 | 2.0 |
| Comparison 5 | 93 | 5.97 | 0.08 | 2.5 |
| Comparison 6 | 88 | 6.02 | 0.08 | 2.5 |
| Example 5 | 82 | 7.97 | 0.08 | 3.5 |
| Example 6 | 85 | 8.21 | 0.06 | 3.0 |

TABLE 2-continued

| photographic performance Sample | Relative Sensitivity | γ | Fog | Dot quality |
|---|---|---|---|---|
| Example 7 | 85 | 8.73 | 0.06 | 3.5 |

As clearly shown in Table 2, a high contrast image with a good dot quality is obtained even when the tetrazolium salt, among substantially the diffusible oxidizing agents, is treated with the MQ developing solution.

COMPARISON 7

A silver iodobromide/gelating emulsion comprising silver halide of 98 mole % bromide and 2 mole % iodide, having an average grain size of 0.4 μ and 75% grains within a range of 0.36–0.44 μ, with a [1.0.0] base was sensitized chemically with sulfur- and gold sensitizers. To the emulsion was added 4-hydroxy-6-methyl-1,3,3a,7-tetraazaindene in an amount of 500 mg per mole of silver. The emulsion was coated on a polyethylene terephthalate support in such amounts that these of the silver and the gelatin were 30 mg and 30 mg per 100 $cm^2$, respectively. Further, gelatin was coated on the emulsion in an amount of 30 mg per 100 $cm^2$ as a protective layer.

The above-mentioned material was wedge-exposed with a tungsten lamp and then processed at 30+ C. according to the following processes:

Developing: 2 min.
Stop fixing: 2 min.
Washing: 5 min.
Drying.

The processing bath was composed as follows:

[Developing solution]
Metol: 1.0 g
Anhydrous sodium bisulfite: 75.0 g
Hydroquinone: 9.0 g
Sodiumcarbonate monohydrate: 29.0 g
Potassium bromide: 4.0 g
Water: to make 1 liter (pH=10.00)

The same composition as in Comparison 1 was employed for the fixing solution.

COMPARISON 8

Comparison 7 was repeated, except that, in advance of coating of the emulsion, a gelatin layer (40 mg of gelatin per 100 $cm^2$) containing a ferric sodium complex of ethylenediaminetetraacetic acid in an amount of 4 g per mole of silver was coated on the polyethylene terephthalate support.

EXAMPLE 8

Comparison 8 was repeated except that, in advance of coating of the emulsion, a gelatin layer (40 mg of gelatin per 100 $cm^2$) containing 2,3,5-triphenyltetrazolium chloride (Compound (3)) in an amount of 40 g per mole of silver was coated on the support instead of the ferric sodium complex of ethylenediaminetetraacetic acid.

The results of Comparisons 7 and 8 to Example 8 are summarized in Table 3.

TABLE 3

| Photographic performance Sample | Relative Sensitivity | γ | Fog | Resolving power (line/mm) |
|---|---|---|---|---|
| Comparison 7 | 100 | 2.61 | 0.04 | 200 |
| Comparison 8 | 97 | 3.96 | 0.04 | 250 |

TABLE 3-continued

| Photographic performance Sample | Relative Sensitivity | γ | Fog | Resolving power (line/mm) |
|---|---|---|---|---|
| Example 8 | 81 | 6.28 | 0.04 | 300 |

As clearly shown in Table 4 light-sensitive material according to the invention possesses superior image characteristics for the high contrast light-sensitive silver halide material.

EXAMPLE 9

To 100 ml of 10 % gelatin solution kept at 40° C. was added 10 ml of 10 % 2,3,5-triphenyltetrazolium chloride (hereinafter referred to as "T-Salt"). To the solution was added diethylhexylsuccinate sulfonic acid (hereinafter referred to as "DES") under vigorous stirring. After cooling, the mixture was made into a noodle-like mass and washed with washing water until no chloride ion was detected. The mixture contained (Compound (39)) and was redissolved and finally made up to 200 ml with water. It was then coated on a polyethylene terephthalate support in an amount of about 2.0 mg per 100 $cm^2$, based on the T-Salt. On the layer was coated a lith type silver chlorobromide emulsion comprising silver halide of 70 mole % silver chloride and 30 mole % silver bromdie, and having an average grain size of 0.25 μ and about 80% grains within a range of 0.19–0.31 μ, in such amounts that those of the silver and the gelatin were 55 mg and 50 mg per 100 $cm^2$, respectively, to prepare Sample A. To the Sample A was coated gelatin with a thickness of 1.5 μ to prepare Sample B. After drying, Samples A and B were wedge-exposed with a tungsten lamp through a gray contact screen and then processed at 30° C. according to the following processes:

Developing: 1 min., 1.5 min., 2 min., 2.5 min.
Stopping: 1 min.
Fixing: 2 min.
Washing: 5 min.
Drying.

The following compositions were employed as the processing solutions:

[Developing solution]
Metol: 3.5 g
Anhydrous sodium sulfite: 40 g
Hydroquinone: 9.0 g
Sodium carbonate monohydrate: 50 g
Potassium bromide: 2.5 g
5-Nitrobenzimidazole: 0.5 g
1-Phenyl-5-mercaptotetrazole: 10 mg
Water: to make 1 liter (pH=10.25)

[Fixing solution]
Ammonium thiosulfate decahydrate: 150 g
Anhydrous sodium sulfite: 10 g
Anhydrous sodium phosphate: 15 g
Water: to make 1 liter (pH=6.20).

The results of Example 9 are summarized in Table 4.

TABLE 4

| Photographic performance Sample | Development Time (min.) | Dot quality | Dot stability |
|---|---|---|---|
| Sample A | 1 | 3.0 | poor |
| " | 1.5 | 3.5 | good |
| " | 2 | 3.0 | poor |
| " | 2.5 | 3.0 | poor |

TABLE 4-continued

| Sample | Photographic performance Development Time (min.) | Dot quality | Dot stability |
|---|---|---|---|
| Sample B | 1 | 3.5 | good |
| " | 1.5 | 4.5 | excellent |
| " | 2 | 4.5 | excellent |
| " | 2.5 | 3.5 | good |

As shown in Table 4, Sample B having the binding upper layer shows less changes in dot quality and dot stability, depending on the change of the development time and possesses a little better dot quality, as compared with Sample A having no binding upper layer. Here, the term "dot stability" means a regularity of the dot quality from small dot at slightly exposed part to large dot at highly exposed part and is expressed as "excellent" if regular, and as "poor", if irregular, by a three stage evaluation.

EXAMPLE 10

A silver halide emulsion containing silver halide of 80 mole % chloride and 50 mole % bromide, having an average grain size of 0.18 μ and 75 % grains within a range of 0.11–0.25 μ was chemically sensitized with a gold sensitizer and thiosulfate. Then, thereinto were added the following:

4-Hydroxy-6-methyl-1,3,3a,7-tetraazaindene:0.78 g
Saponin: 2.5 g
Formaldehyde: 0.5 g
2,3,5-triphenyl-2H-tetrazolium-di-isopropylnaphalene-disulfonate: 1.2 g The thus prepared emulsion, was coated on a polyethyleneterephthalate support in such amounts that those of the silver and the gelatin were respectively 40 mg per 100 $cm^2$ and 22 mg per 100 $cm^2$.

Furthermore, gelatin was coated thereon as a protective layer in an amount of 10 mg per 100 $cm^2$. An exposure and processing were carried out in the same method as in Comparison 7.

COMPARISON 9

The emulsion was prepared and processed in the same method as in Example 10 except that the silver halide was of 1.65 μ in an average grain size and the 25 % grains thereof were within a range of 1.0–2.3 μ.

The results of Comparison 9 and Examples 10 are shown in Table 5.

TABLE 5

| Sample | Photographic performance Relative Sensitivity | Fog | γ | Dot quality |
|---|---|---|---|---|
| Comparison 9 | 100 | 0.05 | 7.01 | 2.5 |
| Example 10 | 75 | 0.04 | 11.72 | 4.0 |

As clear from the above, the sample of the invention is understood as excellently improved in dot quality and high contrast.

What is claimed is:

1. A light-sensitive silver halide photographic material which consists essentially of a support, at least one hydrophilic colloidal layer coated thereon containing silver halide grains having an average grain size of from 0.05 to 1.5 μand at least 75% of which grains being within a range of from 0.6 to 1.4 times said average grain size, and a tetrazolium compound selected from the group consisting of a compound of formulae [I], [II] or [III]:

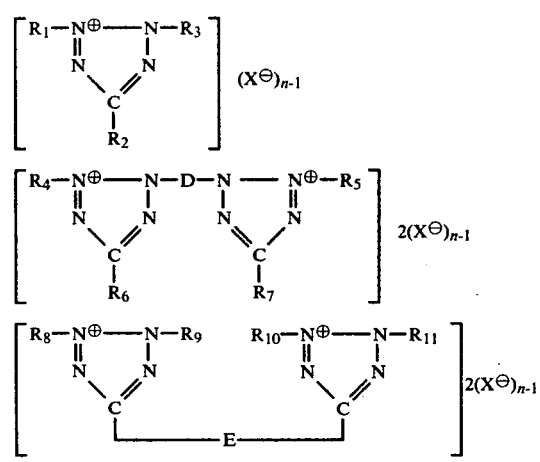

wherein $R_1$, $R_3$, $R_4$, $R_5$, $R_8$, $R_9$, $R_{10}$ and $R_{11}$ each represent an aryl group or a heterocyclic group; $R_2$, $R_6$ and $R_7$ each represents an aryl group, a heterocyclic group, an alkyl group, hydroxyl, carboxyl or the salt thereof, an amino group, mercapto, nitro or hydrogen; D represents a divalent aromatic group; E represents an alkylene group, an arylene group or an aralkylene group; X is an anion; said heterocyclic group being selected from the group consisting of a thiadiazolyl group, a benzothiadiazolyl group, an oxazolyl group, a pyrimidinyl group, a pyridyl group and a 2,5-dimethylthiazolyl group; and n is 1 or 2, provided that the compound forms an intramolecular salt when n is 1.

2. A light-sensitive silver halide photographic material according to claim 1 which material is to be treated with a developing solution containing a hydroquinone and Metol or phenidone and consists essentially of a support, at least one hydrophilic colloidal layer coated thereon containing silver halide grains having an average grain size of from 0.05 to 1.5 μ and at least 75% of which grains being within a range of from 0.6 to 1.4 times said average grain size, and a tetrazolium compound selected from the group consisting of a compound of formulae [I], [II] or [III]:

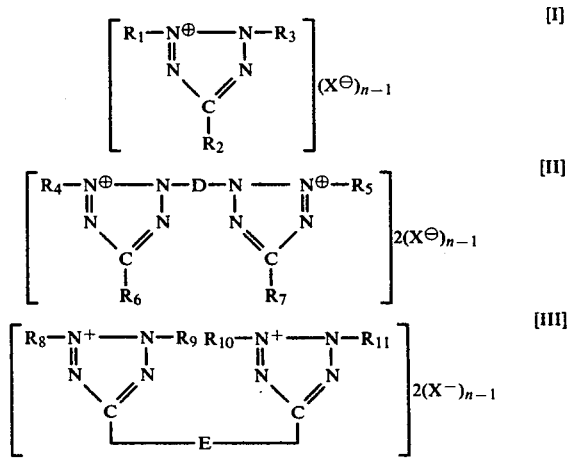

wherein $R_1$, $R_3$, $R_4$, $R_5$, $R_8$, $R_9$, $R_{10}$ and $R_{11}$ each represents an aryl group or a heterocyclic group; $R_2$, $R_6$ and $R_7$ each represents an aryl group, a heterocyclic group, an alkyl group, hydroxyl, carboxyl or the salt thereof, an amino group, mercapto, nitro or hydrogen; D represents a divalent aromatic group; E represents an alkylene group, an arylene group or an aralkylene group; X is an anion; said heterocyclic group being selected from the group consisting of a thiadiazolyl group, a benzothiadiazolyl group, an oxazolyl group, a pyrimidinyl group, a pyridyl group and a 2,5-dimethylthiazolyl group; and n is 1 or 2, provided that the compound forms an intramolecular salt when n is 1, according to claim 1 wherein the tetrazolium compound is non-diffusiable.

3. A light-sensitive silver halide photographic material according to claim 1 wherein the tetrazolium compound is non-diffusible.

4. A light-sensitive silver halide photographic material according to claim 1 wherein the tetrazolium compound is diffusible.

5. A light-sensitive silver halide photographic material according to claim 1 wherein the hydrophilic colloidal layer is a gelatin layer.

6. A light-sensitive silver halide photographic material according to claim 1, wherein the silver halide has an average grain size of from 0.1 to 0.5$\mu$ and at least 80% grains are within a range of from 0.7 to 1.3 times said average grain size, the silver halide being silver chlorobromide or chloroiodobromide containing at least 50 mole % silver chloride.

7. A light-sensitive silver halide photographic material according to claim 1 wherein the tetrazolium compound is present in the at least one hydrophilic colloidal layer.

8. A light-sensitive silver halide photographic material according to claim 1 wherein the photographic material further comprises a gelatin layer adjacent to the at least one hydrophilic layer, the compound being present in the gelatin layer.

9. A light-sensitive silver halide photographic material according to claim 1 wherein the cation moiety of the tetrazolium compound is selected from the group consisting of the following:

(1) 2-(Benzothiazol-2-yl)-3-phenyl-5-dodecyl-2H-tetrazolium
(2) 2,3-Diphenyl-5-(4-t-octyloxyphenyl)-2H-tetrazolium
(3) 2,3,5-Triphenyl-2H-tetrazolium
(4) 2,3,5-Tri(p-carboxyethylphenyl-2H-tetrazolium
(5) 2-(Benzothiazol-2-yl)-3-phenyl-5-(o-chlorophenyl)-2H-tetrazolium
(6) 2,3-Diphenyl-2H-tetrazolium
(7) 2,3-Diphenyl-5-methyl-2H-tetrazolium
(8) 3-(p-Hydroxyphenyl)-5-methyl-2-phenyl-2H-tetrazolium
(9) 2,3-Diphenyl-5-ethyl-2H-tetrazolium
(10) 2,3-Diphenyl-5-n-hexyl-2H-tetrazolium
(11) 5-Cyano-2,3-diphenyl-2H-tetrazolium
(12) 2-(Benzothiazol-2-yl)-5-phenyl-3-(4-tolyl)-2H-tetrazolium
(13) 2-(Benzothiazol-2-yl)-5-(4-chlorophenyl)-3-(4-nitrophenyl)-2H-tetrazolium
(14) 5-Ethoxycarbonyl-2,3-di(3-nitrophenyl)-2H-tetrazolium
(15) 5-Acetyl-2,3-di(p-ethoxyphenyl)-2H-tetrazolium
(16) 2,5-Diphenyl-3-(p-tolyl)-2H-tetrazolium
(17) 2,5-Diphenyl-3-(p-iodophenyl)-2H-tetrazolium
(18) 2,3-Diphenyl-5-(p-diphenyl)-2H-tetrazolium
(19) 5-(p-Bromophenyl)-2-phenyl-3-(2,4,6-trichlorophenyl)-2H-tetrazolium
(20) 3-(p-Hydroxyphenyl)-5-(p-nitrophenyl)-2-phenyl-2H-tetrazolium
(21) 5-(3,4-Dimethoxyphenyl)-3-(2-ethoxyphenyl)-2-(4-methoxyphenyl)-2H-tetrazolium
(22) 5-(4-Cyanophenyl)-2,3-diphenyl-2H-tetrazolium
(23) 3-(p-Acetamidophenyl)-2,5-diphenyl-2H-tetrazolium
(24) 5-Acetyl-2,3-diphenyl-2H-tetrazolium
(25) 5-(Fur-2-yl)-2,3-diphenyl-2H-tetrazolium
(26) 5-(Thien-2-yl)-2,3-diphenyl-2H-tetrazolium
(27) 2,3-Diphenyl-5-(pyrid-4-yl)-2H-tetrazolium
(28) 2,3-Diphenyl-5-(quinol-2-yl)-2H-tetrazolium
(29) 2,3-Diphenyl-5-(benzoxazol-2-yl)-2H-tetrazolium
(30) 2,3-Diphenyl-5-nitro-2H-tetrazolium
(31) 2,2',3,3'-Tetraphenyl-5,5'-1,4-butylene-di-(2H-tetrazolium)
(32) 2,2',3,3'-Tetraphenyl-5,5'-p-phenylene-di-(2H-tetrazolium)
(33) 2-(4,5-Dimethylthiazol-2-yl)-3,5-diphenyl-2H-tetrazolium
(34) 3,5-Diphenyl-2-(triazin-2-yl)-2H-tetrazolium
(35) 2-(Benzothiazol-2-yl)-3-(4-methoxyphenyl)-5-phenyl-2H-tetrazolium
(36) 2,5-Diphenyl-3-$\alpha$-naphthyl-2H-tetrazolium
(37) 3,3'-(3,3'-Dimethoxy-4,4'-diphenylene)-2,2',5,5'-tetraphenyl-di-(2H-tetrazolium).

10. A light-sensitive silver halide photographic material according to claim 1 wherein the light-sensitive silver halide photographic material further comprises an outermost gelatin protective layer having a thickness of from 0.1 to 10 $\mu$ on the hydrophilic colloidal layer.

* * * * *